United States Patent [19]

Nicholson

[11] 4,041,671

[45] Aug. 16, 1977

[54] CONSTRUCTION METHOD

[76] Inventor: William I. Nicholson, 333 E. Hazel St., Inglewood, Calif. 90302

[21] Appl. No.: 662,359

[22] Filed: Mar. 1, 1976

[51] Int. Cl.[2] ..... E04B 1/00

[52] U.S. Cl. ..... 52/741; 52/2

[58] Field of Search ..... 52/2, 741; 264/32

[56] References Cited

U.S. PATENT DOCUMENTS

| | | | |
|---|---|---|---|
| 3,118,010 | 1/1964 | Harrington | 52/2 X |
| 3,225,413 | 12/1965 | Bird et al. | 52/2•UX |
| 3,277,219 | 10/1966 | Turner | 52/2 X |
| 3,357,142 | 12/1967 | Furrer et al. | 52/2 |
| 3,668,287 | 6/1972 | Mackie | 52/2 X |

OTHER PUBLICATIONS

*Principles of Pneumatic Architecture,* Roger Dent. (c) 1972, William Clowes & Sons, Ltd. pp. 51–57.

*Primary Examiner*—Price C. Faw, Jr.

*Assistant Examiner*—Carl D. Friedman

*Attorney, Agent, or Firm*—Blakely, Sokoloff, Taylor & Zafman

[57] ABSTRACT

A method of building homes and the like which provides relatively low cost structures of unique esthetic appearance and requiring little maintenance. The method utilizes inflatable balloons on which substantially rigid, thin shells are formed utilizing reinforced and relatively fast curing materials. The present invention contemplates the fabrication of multiple interconnected shells to provide an integrated construction form. Once this rigid construction form is provided, door and window cutouts may be made and molds and/or frames such as window molds and/or frames fastened in place so that relatively thick structural and insulating materials may be placed over the shells to provide the structural integrity of the building when cured.

40 Claims, 14 Drawing Figures

FIG. 13
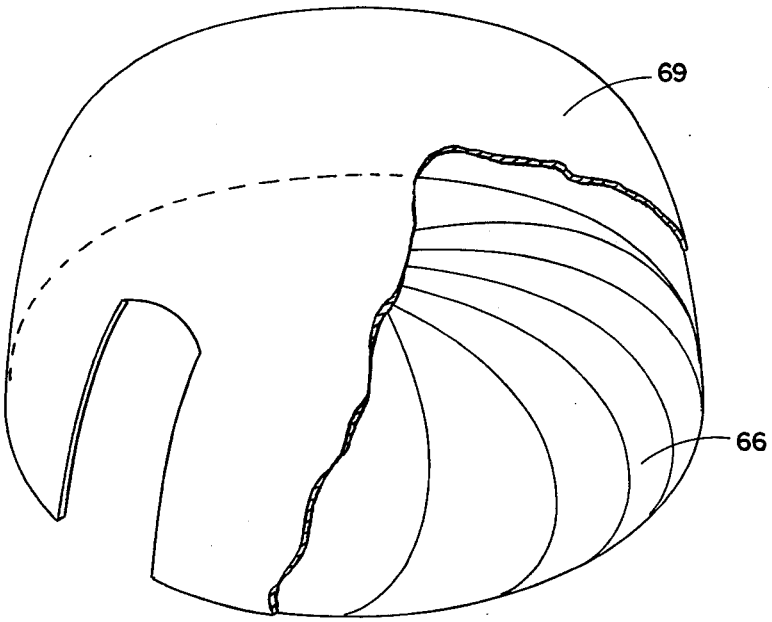
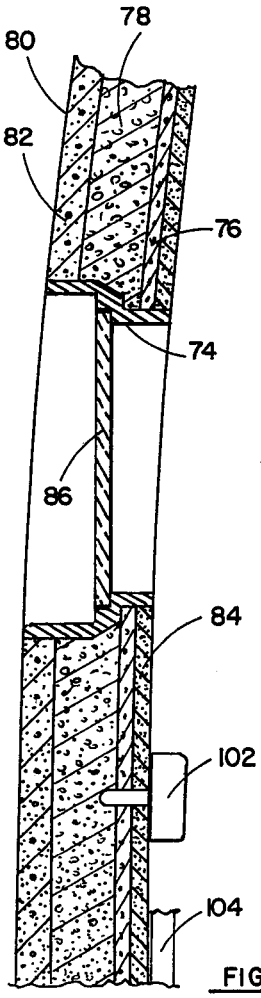
FIG. 4
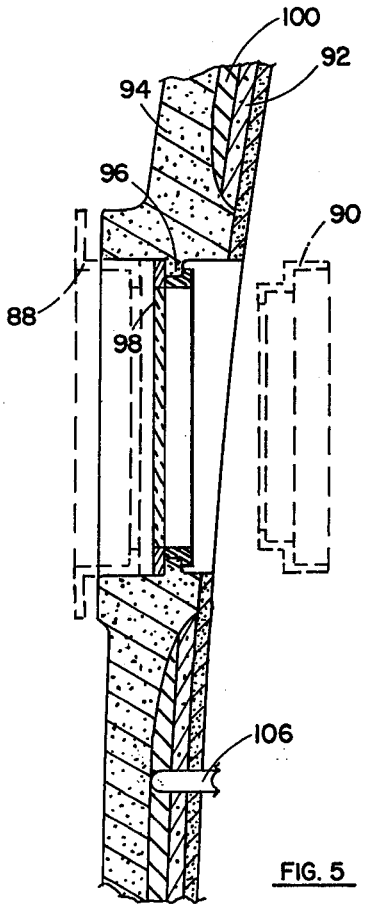
FIG. 5

CONSTRUCTION METHOD

BACKGROUND OF THE INVENTION

1. Field of the Invention

The present invention relates to the field of construction, and more particularly to the one-site construction of multi room homes and the like having relatively low cost and unique esthetic character.

2. Prior Art

The present invention relates to the fabrication of structures generally identified as "dome structures". While the preferred method of practicing the present invention is with respect to the fabrication of complete dome-like structures on a foundation, the method is also useful for such purposes as providing dome or arched roof structures over more conventionally formed walled regions or for the complete fabrication of such structure. Accordingly, only the prior art relating to such structures shall be described herein.

Various methods of fabricating dome structures are known in the prior art. These techniques vary considerably, depending on the character of the resulting structure desired. By way of example, dome structures have been fabricated by providing a mound of dirt in the desired shape, pouring a reinforced concrete shell thereover, and finally removing the dirt under the then self-supporting shell. Other more commonly utilized techniques generally include the assembly of some form of wood or steel supporting structures over which a dome covering of wood, metal, glass or plastic, or combinations thereof is provided. Generally the supporting structure becomes an integral part of the finished building, though some of the structure, such as vertical supports, may be removed when the dome is complete.

A dome structure has also been fabricated through the use of a balloon, wherein a foundation of conventional construction is provided, a balloon is inflated over the foundation, and a structural material such as gunnite or concrete with steel reinforcing is placed thereover to provide the structural shell of the resulting building. Following the curing of the gunnite or concrete, the balloon is deflated and removed through an opening left for this purpose. Such structures have been fabricated in significant numbers by Wallace Neff, a prominent architect, who holds a number of U.S. patents on the various techniques involved. Techniques developed with respect to these systems of the prior art included techniques for providing plumbing and electrical connection, etc. In order to achieve the desired shape, different from that of the balloon, material was placed on the balloon from the top down (see U.S. Pat. No. 2,388,701). However, this general type of structure and fabrication method has not generally been continued in recent years, perhaps because of certain problems and limitations experienced in actually fabricating the structure.

One of the problems sometimes encountered with prior art balloon construction techniques involves the problem of maintenance of balloon inflation and balloon stability over the time required for common cementitious materials to cure. Cement, being made typically from relatively local materials, may exhibit great differences in curing and strength characteristics, sometimes requiring twenty-four hours or more to reach an adequate structural strength. Therefore balloon inflation has to be maintained not only while the cement or gunnite is placed over the balloon, but has to be maintained for some period thereafter which may be as long as 1 day or more. Any substantial variation in balloon pressure or loss of inflation during this curing time would obviously have disasterous results, resulting in the loss of the structure and a substantial cleanup problem before a new structure could be started. Also the balloons themselves are far from rigid when inflated, as pressures are necessarily low because of the sizes of the balloons used. Thus the balloons, as a construction form, are less than ideal for shooting gunnite against or for building cement up against because of their movement and deflection under the loads, particularly the impact loads involved. Also, the shape of the resulting structure depends somewhat on balloon pressure and material thickness and density, and because of variations on these parameters conformance to the "structural model" is less than ideal.

Another problem encountered with such structures involves environmental changes and the heating and cooling of the resulting structure. If the construction technique utilizes a single cement or gunnite reinforced shell, the thermal conductivity of the resulting shell is relatively high, resulting in heat (or cooling) loss through the shell. Also the cooling of the shell from the outdoor environment can cause condensation on the inner shell surfaces, resulting in sweating and perhaps staining of the inner walls. To overcome this problem, shell structures were fabricated utilizing balloons by providing a first inner concrete or gunnite shell, covering the shell with sheets of insulation, and then providing a second outer shell over the insulation. This technique avoids the sweating problem and provides a high degree of insulation in the resulting structure. However, it has the disadvantage that the inner and outer shells are substantially structurally independent shells, and therefore each must be structurally sound and self-supporting.

Also, the dome structures of the prior art are generally single dome structures. To the extent that structures comprising multiple domes may have been fabricated, such structures were generally fabricated by the construction of adjacent domes, subsequently coupled by tunnels or the like. In general, the prior art did not include construction techniques which facilitated the easy fabrication of interconnected dome structures to form integrated multiple dome dwellings.

Another problem of the dome structures of the prior art is the problem of engineering. In construction, and particularly dome construction, it is critical that the load and stress factors be calculated very accurately. The prior art domes always changed shapes considerably with the weight of the cement placed on them. Therefore the curve of the dome was quite different from the original dome form, making it impossible to pre-calculate or accurately engineer the proposed dome before it was built. Also, the change in balloon shape created severe problems with the alignment of windows and door frames and molds which were fastened to the balloon.

BRIEF SUMMARY OF THE INVENTION

A method of building homes and the like which provides relatively low cost structures of unique esthetic appearance and requiring little maintenance. The method utilizes inflatable balloons on which substantially rigid, thin shells are formed utilizing reinforced and relatively fast curing materials. The present invention contemplates the fabrication of multiple interconnected shells to provide an integrated construction form. Once this rigid construction form is provided, door and window cutouts may be made and molds and/or frames such as window molds and/or frames fastened in place so that relatively thick structural and insulating materials may be placed over the shells to provide the structural integrity of the building when cured. Structural shells within which the plumbing and electrical lines may be buried include, as examples, a single layer of cement intermixed with a low density material, such as perlite or foam, and composite layers comprising a layer of cement or gunnite, a second layer of foam and a third layer of cement, gunnite or similar cementitous material. Specific construction techniques, including techniques for integrating adjacent dome structures and for using disposable and nondisposable balloons are disclosed.

BRIEF DESCRIPTION OF THE DRAWINGS

FIGS. 4 and 5 are cross-sectional views illustrating two methods of forming window breakouts.

FIG. 13 is a representation of one dome shaped construction form shell, illustrating the collapse and retrieval of the reuseable balloon used to form the construction form shell.

DETAILED DESCRIPTION OF THE INVENTION

Figure 1:
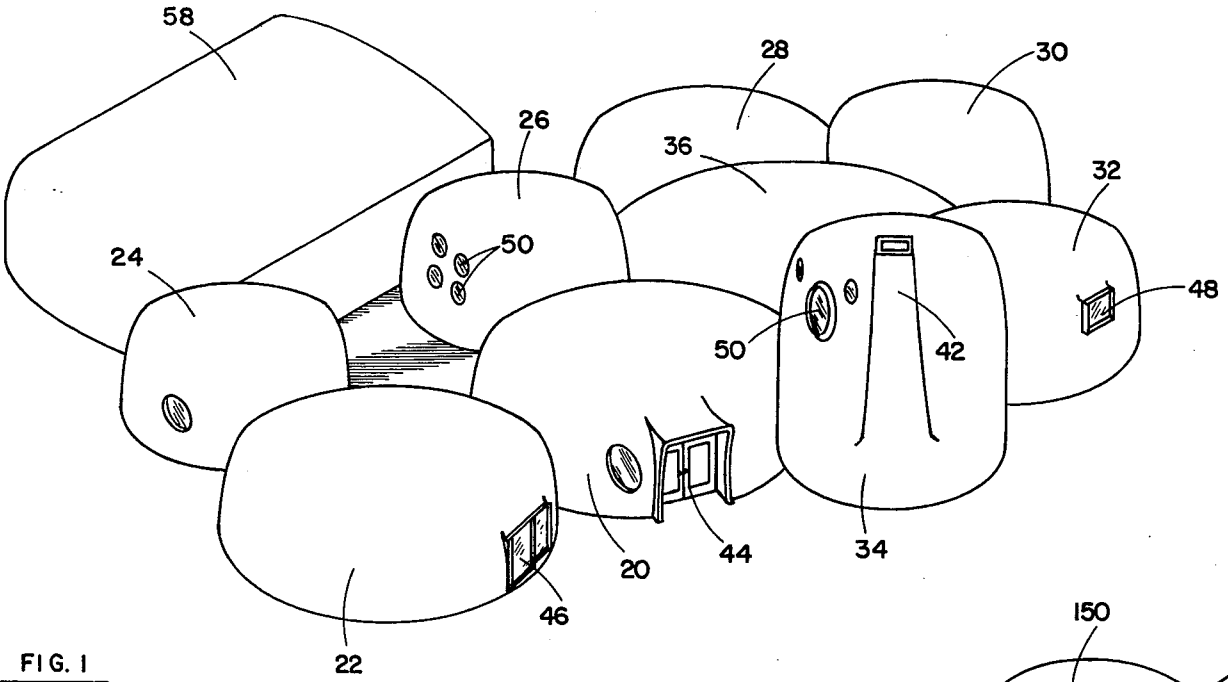
FIG. 1 is a perspective view of a home constructed with the methods of the present invention.
Figure 2:
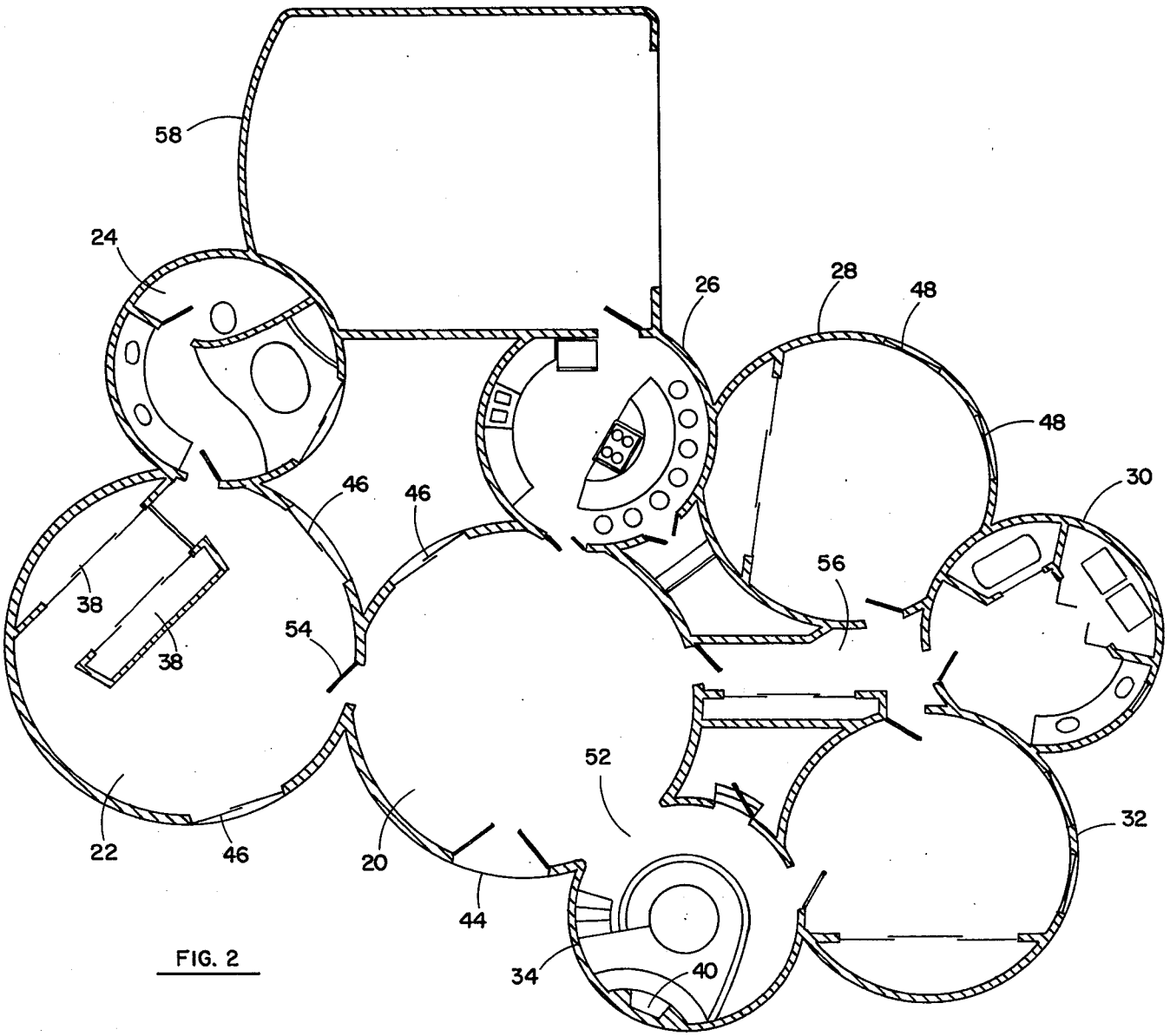
FIG. 2 is a floor plan of the home of FIG. 1.

First referring to FIGS. 1 and 2, a perspective view and a floor plan of one particular home built in accordance with the methods of the present invention may be seen. This particular home has approximately 2,400 square feet of living space and is complete with a two-car garage. The home itself is comprised of eight dome structures 20, 22, 24, 26, 28, 30, 32 and 34, with a further dome-like roof 36 over the area falling between the domes 20, 26, 28, 30, 32 and 34 to provide a hallway, storage areas, etc. therebetween. Each of these domes is coupled to at least one other dome so as to define a doorway or entryway therebetween. By way of example, dome 20, which is the main living room-dining room area is coupled to the master bedroom dome 22 having closets 38, which in turn coupled to a master bathroom dome 24. Domes 20 through 32, while varying somewhat in size in this embodiment, range from approximately 16 feet in diameter for domes 24, 36, etc. to 24 feet in diameter for domes 20 and 22. Also, these domes range in height from approximately 9 feet for the shorter domes to approximately 12½ feet for domes 20 and 22, with dome 34 having a height of 22 feet for accent purposes. While this dome could be used as a two story structure, in the embodiment shown a sunken fireplace 40 is provided with a chimney 42 projecting up the wall of the dome, being partially visible from the inside and partially from the outside. There is also provided a double-door entryway 44 on the living room-dining room dome 20, sliding glass doors 46 and various conventional windows 48. Also for purposes of accent free-form stained-glass windows, such as windows 50, are used to create a most appealing effect both inside and outside the structure.

It may be seen from FIG. 2 that in certain instances, two domes intersect to define an opening or archway therebetween, such as the archway or opening 52 between domes 20 and 34. In other instances, such as in the doorway 54 between domes 20 and 22, the circular contour of dome 22 intersects and slightly continues into dome 20 to provide a slight bulge or protection into dome 20 around the doorway 54. In still other instances, such as in the intersection of domes 30 and 32, the circular base of dome 32 projects into dome 30 though no doorway or walkway is provided in this region of intersection, as access to dome 30 which is a second bathroom, and access to the additional bedrooms 28 and 32, is through the hallway 56. Thus the second bathroom is readily accessible even from the kitchen dome 26, which couples not only to the dining room portion of the living room-dining room dome 20, but also provides an entrance into the two-car garage 58. As may be seen in FIG. 1, the garage 58, being curved somewhat adjacent the rear thereof, is more rectangular in planform with the roof curvature being predominantly that of an arc as opposed to a dome-shaped structure.

To build a structure in accordance with the present invention, such as the structure illustrated in FIGS. 1 and 2, a concrete foundation is first provided. Such a foundation, while deviating from conventional foundations in its planform because of the dome-like structures to be fabricated thereon, may otherwise be provided using conventional techniques, i.e., a poured concrete foundation with a reinforced footing around the periphery thereof. Where desired, water and electrical outlets may be provided through the foundation for tubs and the like, and sunken regions such as the sunken firepit may be provided for architectural accents, as such accents integrate extremely well into the most unique appearing structure achieved by the present invention. Also, as will be subsequently explained in detail, the periphery of the foundation may be provided with special configurations, and in any event will typically be provided with protruding rebar (conventional reinforcing steel) segments for providing tie points for the resulting dome structures.

There are two approaches which may be used when practicing the present invention, the first utilizing reusable balloons, and the second utilizing balloons which become an integral part of the finished structure. Obviously reusable balloons have the advantage that the cost of the balloons may be amortized over a substantial number of structures, though additional on-site labor is required to reclaim the balloons for later reuse. Also, as shall subsequently be seen, the present invention contemplates the fabrication of a thin shell or dome structure which serves as a construction form only, and in general this construction form will require some form of at least modest reinforcement which may be provided by the materials of the expendable balloon itself, or by a sock like cover of reinforcement material over a reusable balloon. Both of these methods of practicing the present invention will be described in detail herein.

Figure 3:
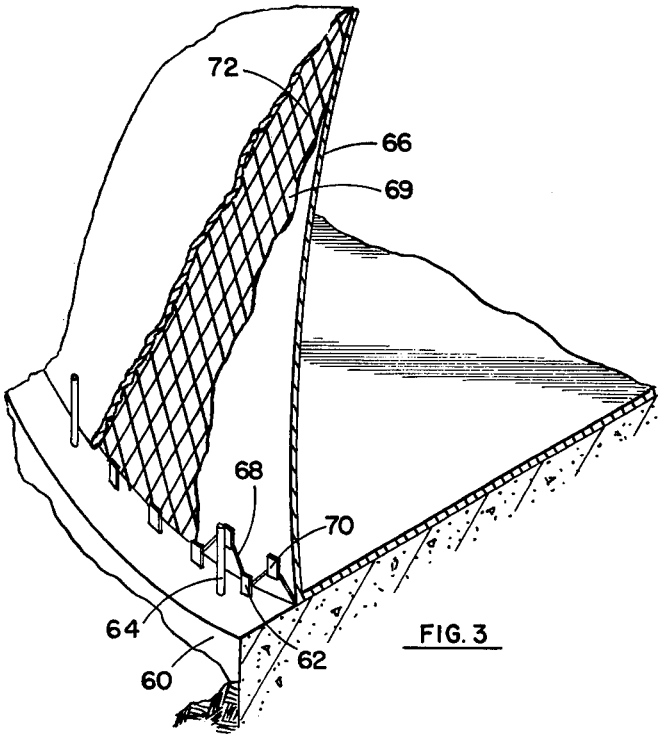
FIG. 3 is a cross-sectional view partially cut away illustrating the balloon tie-down.

Now referring to FIG. 3, an illustration of the method using a reusable balloon may be seen. The foundation 60 is provided with a plurality of temporary tie points 62, in addition to the protruding rebar segments 64 for integrating the resulting structure into the foundation. The tie points 62 may simply be wires or sheet metal hooks placed into the concrete before the foundation sets, or may be strips of chicken wire or the like to provide tie points to hold down the balloon. Thereafter the balloon 66 of appropriate size is disposed over the foundation and fastened to the tie points 62 by a line 68 looping between the tie points 62 and loops 70 sewn to the balloon. The balloon itself may be fabricated from various materials, though conventional sail cloth has been found particularly suited for this purpose as sail cloth (tightly woven nylon) is relatively impervious to air, is relatively light, yet holds its shape very well and is a tough and durable material. Polyethylene is ideal for line 68, as it does not stick to the materials used, and may be readily removed to reclaim the balloon.

After the balloon is fastened in place on the foundation and inflated, a thin shell of relatively fast-curing material is disposed over the balloon, which thereafter may be used as a substantially rigid construction form for fabrication of the structure itself. Various materials may be used for this construction form shell, though one approach illustrated in FIG. 3 is to provide a second loose-fitting reinforcement sock such as a hemp sock 72 over the balloon 66, and to then spray the hemp with a material which will harden or cure in a relatively short time. Suitable materials for this purpose include certain plasters, and polyester resin. Preferably, the material is applied from the foundation up to maximize its self supporting characteristics and to minimize the deformation of the inflated form and deviation from the "engineering model" shape. While the cost of materials for this shell is a very significant consideration, hemp is quite inexpensive and the amount of resin required to rigidify the hemp may be held at a minimum so that the overall cost of the construction shell, including labor, may be kept quite low. Also the amount of resin used should be kept to a minimum so that the resulting surfaces of the construction shell are rough, even perhaps porous, so that subsequent layers of cementitious materials will adhere well to the shell.

Once the shell 69 has been formed and the balloon deflated (see FIG. 13) and removed therefrom, the door and window cutouts and any other cutouts required may be made in the shell, using a handsaw such as a hand sabre saw. Of course for the larger cutouts such as for double doors, sliding glass doors and the like a substantial portion of that area of the shell may be left open (see FIG. 13 again) for the removal of the balloon so that only trimming to size is required. In any event, once the cutouts are complete, door and window forms, preferably fiberglass forms, are taped into position around the cutouts to preserve the geometry of the cutouts during the fabrication of the structure.

Two types of fiberglass forms have been used for such openings. The first type of form, illustrated in FIG. 4, utilizes a fiberglass form 74 which becomes a permanent and integral part of the building, being initially taped to the construction form 76 and buried within the structure subsequently formed by the build up of a urethane foam insulating layer 78 and an outer structural layer of gunnite or blown concrete 80 having steel reinforcement 82 therein. An inner finish plaster coat 84 provides the desired texture and hardness on the inner walls of the structure, with the fiberglass form 74 being receptive to screws, mounting clamps and the like for retaining windows, such as windows 86.

As an alternative, a removable fiberglass form may be used as is illustrated in FIG. 5. This form, actually constructed in two pieces 88 and 90 shown in phantom, may be temporarily clamped together and fastened in place over the construction form 92 so as to mold the concrete shell 94 around the window region, and more particularly to mold an internal lip 96 to which a window frame 98 may be readily clamped. In this case the layer of foam inculation 100 is not continued to the region of the window, so that the periphery of the window opening is defined entirely by structural materials. Of course before providing the foam layer 78 in the break out form shown in FIG. 4, or the layer 100 shown in FIG. 5, wall sockets 102 may be disposed on the construction form and wired by way of wiring which will be buried in the subsequently formed shells and water lines such as the water lines 104 and 106 may be either buried in the subsequently formed shells, or may be disposed just within the construction shell in those situations where the water lines will be behind cabinets or the like within the finished structure.

For door breakouts it has been found convenient to use a removable fiberglass mold similar to that shown with respect to the window breakouts in FIG. 5, or permanent forms like the window forms described above. In the case of removable forms, after the concrete has set the mold is removed, bolt holes are drilled with a masonary drill in the appropriate locations, and conventional door frames are bolted in place using conventional bolts and lead shields in the anchor holes.

Figure 6:
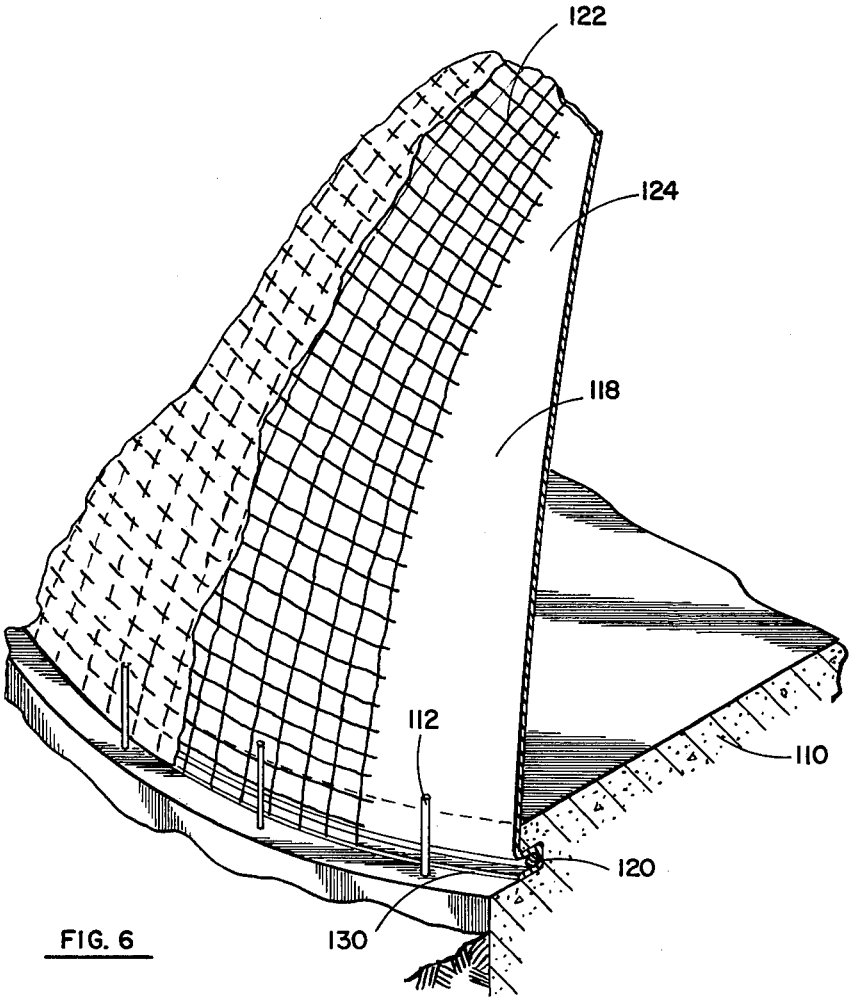
FIG. 6 is a cross-sectional view, partially cut away, illustrating an alternate form of balloon tie-down.
Figure 7:
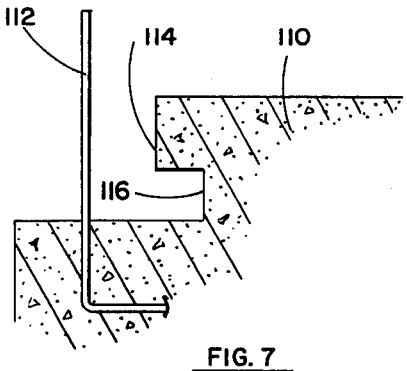
FIGS. 7 and 8 are cross-sectional views illustrating two different local foundation geometries.
Figure 8:
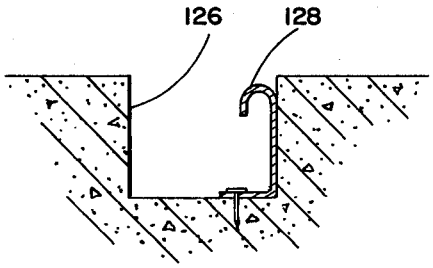

Now referring to FIGS. 6, 7 and 8 an alternate method of practicing the present invention using disposable balloons may be seen. In this method the foundation 110 is formed with the rebar tie downs 112 around its perimeter, with a lip 114 and groove 116 adjacent the rebars so that the balloon 118 may be placed over lip 114 and tied into position in groove 116 by a line or strap 120. This provides both a good anchoring of the balloon and a positive locating reference therefor. (Similar tie downs may be used with reuseable balloons.) Suitable balloons may be fabricated from a woven hemp 122 sewn to a heavy paper backing or like material 124. Since the inflation pressures are relatively low (on the order of ½ oz. per square inch) small inadvertent tears or punctures of the paper are of little consequence. As before, a resin, plaster or the like may be used to harden the balloon to provide the rigid construction form to support the subsequently formed structural shell until the structural shell has cured. (For those areas of the balloon which are not adjacent the edge of the foundation, e.g. where two dome structures will interconnect, a small groove such as groove 126 shown in FIG. 8 may be cast into the foundation and a sheet metal or extruded anchor member 128 may be nailed into position in the groove to continue the tie-down around the periphery of the balloon in these areas. As an alternative, balloon tie down may be achieved with anchors set at floor level.)

The method illustrated with respect to FIGS. 6 through 8 has been described with respect to disposable balloons, and in such case to assure a better tie down of the balloons it is desirable to provide a thickened lip 130 on the lower edge of the balloon such as by sewing a cord into this lower edge or sewing in a double or triple thickness of the balloon. However, this same method has been used successfully with respect to recoverable balloons by using not only a tie down line 120, but also a cord sewn into the lower edge of the balloon 130 which may be removed prior to the removal of the balloon itself. Thus the method illustrated with respect to FIG. 6 through 8 is not limited only to disposable balloons, and has some advantages even with respect to reusable balloons in that the integrity of the balloon tie down, a most important consideration, is quite high. Again, polyethylene line for line 180 is preferred if the balloon is to be reuseable.

Figure 9:
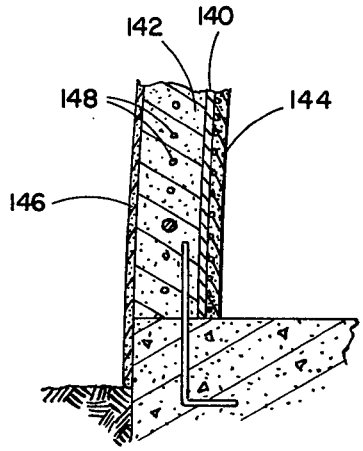
FIG. 9 is a cross-sectional view taken at the base of the structure illustrating the various layers of the structure and the method of integrating a structure into the foundation reinforcement.

In the embodiments hereinbefore described the balloons have been used to first provide a rigid construction form shell which then is sprayed with a plastic foam such as the urethane foam, followed by a substantial layer of gunnite or blown concrete and typically followed with an inner finish coat of plaster, and if desired, an outer finish coat of plaster. An alternate, however, may be seen in FIG. 9. In this case the construction form shell 140 is covered with a single relatively thick layer of concrete intermixed with small plastic foam particles or balls to provide a structurally sound, yet thermally insulative layer 142, with finish coats 144 and 146 providing the desired decorative and hard finish coat layers. Thus whereas the construction form shell normally has an average thickness of less than 1 inch, and typically of less than ½ inch, and the foam and concrete layers are normally each in the range of 1 to 2 inches, the single structural shell 142 of FIG. 9 will normally have a thickness of at least 2 inches, and more preferably of at least 3 inches, being reinforced with steel reinforcing such as chicken wire 148.

Having now described the basic technique for forming single dome structures, techniques in accordance with the present invention for incorporating this method into multiple dome structures of the type shown in FIGS. 1 and 2 will now be described. In particular, once one of the construction form shells for one of the domes in a multiple dome structure is fabricated (e.g., before the structural materials are placed thereover) the preferred method of practicing the present invention contemplates the fabrication of the remaining dome shell construction forms in sequence, so that a complete form for a multiple dome structure is completed prior to the application of the structural materials. This procedure has a number of advantages in that it allows the rapid fabrication of the construction forms utilizing the fast curing materials, with the subsequent operations of applying one or more structural materials allowing a one step application for the entire structure (or at least for the portion of the structure other than covered areas such as the hallway area 36). This also results in a total integration of the structure, providing maximum strength, optimum integration of the reinforcing used such as chicken wire which may be placed over the multiple construction form shells, and avoids cracking or seepage which might otherwise occur where newly applied structural materials mate with previously applied and fully cured structural materials.

Figure 10:
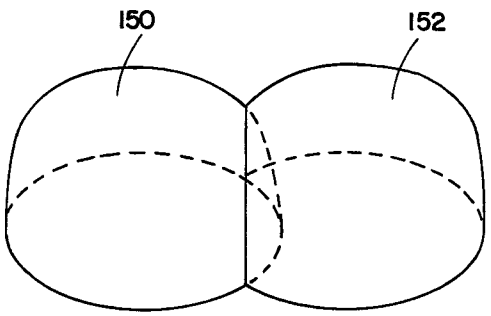
FIG. 10 is a view illustrating the intersection of two dome construction forms.
Figure 10A:
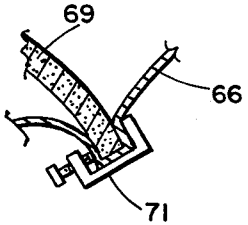
FIG. 10A is a local cross-section of a doorway breakout in one construction form shell illustrating the tie-down of a balloon for an adjacent construction form shell balloon thereto.

To achieve the integration of construction form shells, the first shell is formed in the manner hereinbefore described. Thereafter the balloon for the adjacent shell is disposed on the foundation and fastened down according to the previously described techniques which, of course, will vary depending upon such factors as whether or not the balloon is to be recoverable. Part of the base of the balloon however, and the section of the side thereof, will be intersected by the construction form shells previously formed. Therefore, a section of the base of the balloon may not be tied to the foundation in the conventional manner, though may be readily fastened to the neighboring shell so as to effectively tie down the balloon in a relatively air-tight manner. In fact, suitable tie downs may be provided in shells when formed to provide tie downs for the adjacent next ballons. In this regard, it should be noted that typically the extent of overlap or interference is relatively minor compared to the overall balloon size, and the balloon position will be relatively well defined by that portion of the balloon which is tied to the foundation. The coupling of the interfering section of the balloon with the previously fabricated construction form shell may be by fastening the balloon to the foundation adjacent the base of the previously erected balloon, by taping, wiring, etc. the balloon to the previously formed shell, or even cementing or stapling the balloon to the previously formed shell if the balloon is not to be recoverable. The interference of a typical construction form shell 150 with an adjacent balloon 152 is illustrated in FIG. 10, and essentially duplicates the interference which ultimately will be obtained in the finished structural domes. Where a balloon intersects an entry into a previously formed shell, clamps such as clamps 71 (see FIG. 10A) may be used to tie down the balloon in that region.

Referring again to FIGS. 1 and 2, it will be noted that the roof region 36 does not represent a roof of a dome shell, that is, a shell or structure having a circular base or a substantial segment of a circular base, but instead represents a roof region coupling the adjacent interconnected and encircling domes. This roof region, however, is constructed in the same manner as the domes themselves. One method is to form this roof after the structural material has been placed on the dome construction forms so as to provide structural walls separating the hallway 56 and closet areas from the dome areas. Thus, after the structural materials are placed on the dome construction forms, an additional balloon cover is disposed over region 36 and coupled to the sides or bases of the adjacent domes for inflation and rigidifying, etc. for the subsequent formation of the structural roof, proceeding as with the domes themselves. Obviously reinforcement may be left on the adjacent domes to structurally integrate the roof region 36. (Care should be taken to avoid low points, so that this region will adequately and completely drain during rains.)

The preferred method, however, for forming the roof region 36 is to first form the construction form shell over this region immediately after the construction form shells for the adjacent domes have been formed. Thus the construction form shells for the entire structure are first formed in the preferred embodiment, and thereafter the structural materials, insulation, etc. are applied to complete the structure. Obviously by using this technique, part of the structural walls for the domes 26, 28, 30, 32, 34 and 20 fall within or under the construction form shell for roof 36. Accordingly structural material is applied to these regions from within the construction form shells to continue and complete the structure of the various domes even under the roofed regions 36. Preferably in the regions falling under the roof region 36, the foam insulation layer is omitted as it is not necessary for either installation or wall thickness considerations.

The garage structure of the home shown in FIGS. 1 and 2 is slightly more conventional in its geometry because of the requirements for the particular space. Thus its construction may proceed, at least initially, in somewhat more conventional manner.

Preferably the walls such as the side walls, front and back of the garage are constructed utilizing conventional cement block construction techniques or, in the alternative, similar techniques such as by way of example, providing molded concrete walls. Thereafter a balloon is fastened thereover for formation of a roof construction form shell, which then is coated with a structural material at the same time as the other construction form shells. This roof balloon for the garage area 58 is a shallow balloon, primarily characterized by a two dimensional arc except in the end regions, rather than a three dimensional dome shape. By fastening the balloon in position on the inner surface of the garage walls at the top thereof, integration of the garage roof reinforcement with reinforcement in the side walls is easily accomplished.

Figure 12:
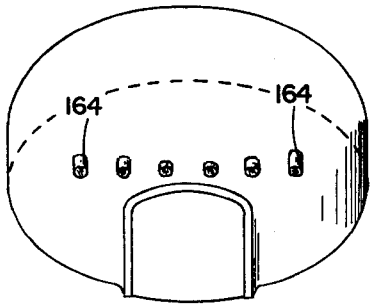
FIG. 12 is a schematic representation illustrating the incorporation of certain other architectural accents to create a Spanish motif.

The present invention method has been described in detail with respect to the construction of the structure of FIGS. 1 and 2. It should be noted however that various other types of structures and aesthetic effects may readily be achieved using the fundamental concept of the present invention of first fabricating a substantially rigid construction form shell utilizing an inflatable balloon, and thereafter forming the structure over the construction form shell. By way of specific example, dome roofs may be constructed over sidewall enclosures fabricated by conventional techniques as illustrated, in an exemplary manner only, in FIG. 11. Thus in this figure a simple square walled enclosure 160 is first constructed utilizing the conventional construction techniques such as by way of example, brick or cement block walls, with the domed roof 162 being fabricated thereover and integrated into the reinforcing for the walls in the same manner that the domes of the hereinbefore described embodiments are integrated into the reinforcing of the building foundation. In construction of a roof or a structure similar to that shown in FIG. 11, the balloon would be fabricated to have varying curvature so as to provide a smooth integration of the general dome shape into the more geometric outline of the walls. Similarly, as illustrated in FIG. 12, various architectural accents may readily be achieved. In particular, in that FIGURE wooden posts 164 have been integrated into the dome structure which, together with free flowing door breakouts, etc. may be utilized to create a Spanish motif.

Figure 11:
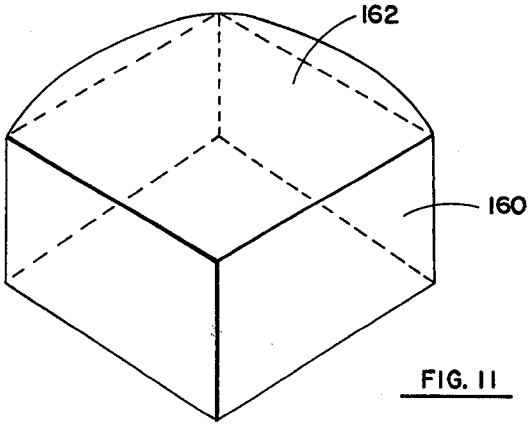
FIG. 11 is a schematic illustration of a square structure having a dome roof fabricated in accordance with the present invention.

In furtherance of the foregoing, structures similar to the structure of FIG. 11, as a single structure or a multiple unit structure, may be fabricated in its entirety using the present methods. In particular, an inflatable form having the desired shape and having more rigid walls, and/or being temporarily supported by internal supports may be used, with construction otherwise proceeding as previously described.

The present invention has been disclosed and described herein with respect to the construction of a home comprising a plurality of domes utilizing various aspects of the invention, and incidentally with respect to other types of structures which may be fabricated with the present invention. In its simplest form, the present invention contemplates the fabrication of a structure, first by the formation of a construction form shell using one or more balloons, and then by the formation of the structural shell over the construction form shells.

The fabrication of construction form shells in accordance with the present invention contemplates the convenient and easy integration of a plurality of domes, dome sizes and other shapes into structures of extremely varied and unique aesthetic character, a result not achieved in the prior art. Furthermore, the present invention allows a minimum of separate operations at the construction site and a minimization of the repeat of any such operations by allowing first, the complete formation of the construction form shells, followed by the complete formation of the structural shells. This is to be compared with the prior art techniques utilizing balloons which were not really suitable or contemplated for use in the construction of structures comprising a plurality of domes. Of course other materials may be used for the construction of the construction form shells, for the structural materials and the reinforcement thereof, or for the insulating materials, though the use a a sprayed on foamed in place plastic foam is preferred because of its ease of application, its insulating qualities and its adherence to the adjacent materials, tending to tie all layers of the structural shells together.

Thus while the present invention has been disclosed and described with respect to preferred embodiments thereof, it will be understood by those skilled in the art that various changes in the method of practice and the materials used in the present invention may be made by those skilled in the art without departing from the spirit and scope of the invention.

I claim:

1. A method of forming building structures comprising:

a. providing a foundation;

b. placing a balloon having a shape substantially similar to part of the building to be formed over part of the foundation and inflating the balloon;

c. providing a layer of material on the balloon to form a substantially rigid construction form shell;

d. placing a balloon having a shape substantially similar to another part of the building to be formed over part of the foundation so that the base of the balloon is intersected by the shell formed in step (c);

e. providing a layer of material on the balloon of step (d) to form a substantially rigid construction form shell intersected by the shell formed in step (c) to form one integral shell; and f. providing at least one layer of material over the construction form shell, which when cured, will provide the structural shell of the building.

2. The method of claim 1 wherein a loose fitting covering is placed over the inflated balloons of steps (b) and (d) before proceeding with the next step.

3. The method of claim 2 wherein the layers of materials applied in steps (c) and (e) rigidize the loose fitting coverings over the balloons.

4. The method of claim 1 wherein the integral construction form shell is formed with an average thickness not exceeding 1 inch.

5. The method of claim 1 wherein the construction form shell is formed with an average thickness not exceeding ½ inch.

6. The method of claim 1 wherein steps (c) and (e) each comprise the steps of providing a layer of resinous material over the balloon having a curing time of less than 1 hour.

7. The method of claim 1 wherein step (f) comprises the step of providing at least one layer of material over the construction form shell which when cured will provide a structural shell of the building having an average thickness of at least 2 inches.

8. The method of claim 1 wherein step (f) comprises the step of providing at least one layer of material over the construction form shell which when cured will provide a structural shell of the building having an average thickness of at least 3 inches.

9. The method of claim 1 wherein step (f) comprises the step of providing a layer of a mixture of cement and a low density filler over the construction form shell which when cured will provide the structural shell of the building.

10. The method of claim 9 wherein the mixture further includes a polymeric resin.

11. The method of claim 9 wherein the low density filler is perlite.

12. The method of claim 9 wherein the low density filler is comprised of a plastic foam.

13. The method of claim 1 wherein the shells formed in steps (c) and (e) are terminated substantially at their intersection to form an archway therebetween.

14. The method of claim 1 wherein the shell formed in step (c) extends at least partially into the geometric form of the shell formed in step (e).

15. The method of claim 14 wherein step (f) includes the application of the structural layer over the shell formed in step (c) within the shell formed in step (e).

16. The method of claim 1 wherein steps (d) and (e) are successively repeated to provide an integral grouping of shells disposed around an area, and further comprised of the steps of placing a balloon over the area between shells and inflating the balloon, and providing a layer of material on the balloon to form a roof construction form shell over the area before proceeding with step (f).

17. The method of claim 16 wherein the balloon placed over the area between shells is at least temporarily retained by attachment to the side of at least some of the previously formed shells.

18. The method of claim 1 wherein the layers of material applied in steps (c) and (e) at least partially penetrate and rigidize the balloons.

19. The method of claim 1 wherein the balloons are recovered by deflation and removal from the construction form shells.

20. The method of claim 1 wherein the balloons of steps (b) and (d) are different size balloons.

21. The method of claim 1 further comprised of providing window and door cutouts in the shell and fastening molds over the cutouts before proceeding with step (f).

22. The method of claim 21 wherein the molds are recovered after step (f).

23. The method of claim 21 wherein the molds become integrated into the resulting structure.

24. The method of claim 1 wherein the step of providing a foundation includes the step of providing a foundation having walls defining at least a part of the desired finished structure.

25. The method of claim 1 wherein the base of each balloon has a substantially circular free form periphery.

26. A method of forming structures comprising the steps of:

a. providing a foundation;
b. placing a balloon having a shape substantially similar to part of the building to be formed over part of the foundation and inflating the balloon;
c. providing a layer of material on the balloon to rigidify the balloon to form a substantially rigid construction form shell;
d. placing a balloon having a shape substantially similar to another part of the building to be formed over part of the foundation so that the base and part of the lower part of the balloon is intersected by the shell formed in step (c);
e. providing a layer of material on the balloon of step (d) to rigidify the balloon to form a substantially rigid construction form shell coupled to the shell formed in step (c) to form one integral shell; and
f. providing at least one layer of structural material over the construction form shell which, when cured, will provide the structural shell of the building.

27. The method of claim 26 wherein the shells formed in steps (c) and (e) are terminated substantially at their intersection to form an archway therebetween.

28. The method of claim 26 wherein the shell formed in step (c) extends at least partially into the geometric form of the shell formed in step (e).

29. The method of claim 28 wherein step (f) includes the application of the structural layer over the shell formed in step (c) within the shell formed in step (e).

30. The method of claim 26 wherein steps (d) and (e) are successively repeated to provide an integral grouping of shells disposed around an area, and further comprised of the steps of placing a balloon over the area between shells and inflating the balloon, and providing a layer of material on the balloon to form a roof construction form shell over the area before proceeding with step (f).

31. The method of claim 10 wherein the balloon placed over the area between shells is at least temporarily retained by attachment to the side of at least some of the previously formed shells.

32. The method of claim 26 wherein the step of providing a foundation includes the step of providing a foundation having walls defining at least a part of the desired finished structure.

33. A method of forming structures comprising the steps of:

a. providing a foundation;
b. placing a balloon having a shape substantially similar to part of the building to be formed over part of the foundation and inflating the balloon;
c. placing a loose fitting sock-like covering over the balloon;
d. providing a layer of material on the covering to rigidify the covering to form a substantially rigid construction form shell;
e. placing a balloon having a shape substantially similar to another part of the building to be formed over part of the foundation so that the base and part of the lower part of the balloon is intersected by the shell formed in step (d);

f. placing a loose fitting sock-like covering over the balloon of step (e);

g. providing a layer of material on the covering of step (f) to rigidify the covering to form a substantially rigid construction form shell coupled to the shell formed in step (d) to form one integral shell; and h. providing at least one layer of structural material over the construction form shell which, when cured, will provide the structural shell of the building.

34. The method of claim 33 further comprised of the step of deflating and recovering the balloons for reuse.

35. The method of claim 33 wherein the shells formed in steps (d) and (g) are terminated substantially at their intersection to form an archway therebetween.

36. The method of claim 33 wherein the shell formed in step (d) extends at least partially into the geometric form of the shell formed in step (g).

37. The method of claim 36 wherein step (h) includes the application of the structural layer cover the shell formed in step (d) within the shell formed in step (g).

38. The method of claim 33 wherein steps (e), (f) and (g) are successively repeated to provide an integral grouping of shells disposed around an area, and further comprised of the steps of placing a balloon over the area between shells and inflating the balloon, and providing a layer of material on the balloon to form a roof construction form shell over the area before proceeding with step (h).

39. The method of claim 38 wherein the balloon placed over the area between shells is at least temporarily retained by attachment to the side of at least some of the previously formed shells.

40. The method of claim 33 wherein the step of providing a foundation includes the step of providing a foundation having walls defining at least a part of the desired finished structure.

* * * * *

UNITED STATES PATENT AND TRADEMARK OFFICE

CERTIFICATE OF CORRECTION

PATENT NO. : 4,041,671
DATED : August 16, 1977
INVENTOR(S) : William I. Nicholson It is certified that error appears in the above-identified patent and that said Letters Patent are hereby corrected as shown below:

Column 1, line 7, "one-site" should be -- on-site --.

IN THE CLAIMS:

Column 12, Claim 31, line 47, "10" should be -- 30 --.

Column 14, Claim 37, line 5, "cover" should be -- over --.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*